US005149451A

United States Patent [19]

Tull

[11] Patent Number: 5,149,451

[45] Date of Patent: Sep. 22, 1992

[54] WATER SOLUBLE SALT PRECOATS FOR WIRE DRAWING

[75] Inventor: Thomas W. Tull, Southfield, Mich.

[73] Assignee: Henkel Corporation, Ambler, Pa.

[21] Appl. No.: 658,927

[22] Filed: Feb. 21, 1991

Related U.S. Application Data

[60] Division of Ser. No. 492,697, Mar. 13, 1990, Pat. No. 5,012,262, which is a continuation of Ser. No. 307,643, Feb. 7, 1989, abandoned.

[51] Int. Cl.[5] ..... C10M 125/22; C10M 173/02

[52] U.S. Cl. ..... 252/18; 252/49.3

[58] Field of Search ..... 252/18, 49.3

[56] References Cited

U.S. PATENT DOCUMENTS

| | | | |
|---|---|---|---|
| 2,664,399 | 12/1953 | Kluender | 252/18 |
| 2,957,825 | 10/1960 | Henricks | 252/18 |
| 3,111,218 | 11/1963 | Huet | 252/18 |
| 3,836,467 | 9/1974 | Jones | 252/18 |
| 4,138,348 | 2/1979 | Grasshoff | 252/18 |
| 4,170,307 | 12/1987 | Périard et al. | 252/18 |
| 4,719,084 | 1/1988 | Schmid et al. | 252/34 |
| 5,012,662 | 5/1991 | Tull | 252/49.3 |

*Primary Examiner*—Prince Willis, Jr.
*Assistant Examiner*—Jerry D. Johnson
*Attorney, Agent, or Firm*—Ernest G. Szoke; Wayne C. Jaeschke; Norvell E. Wisdom, Jr.

[57] ABSTRACT

Compositions for coating steel wire to facilitate the cold drawing thereof comprising:

A. from about 50 to about 99.9% by weight of $K_2SO_4$;

B. from about 0 to about 49.99% by weight of $K_2B_4O_7$ and/or $KBO_2$; and

C. from about 0.01 to about 5% by weight of an ammonium and/or a potassium soap; wherein up to 50% by weight of the total potassium plus ammonium ions in the composition can be replaced by sodium ions. These compositions form coatings which have good crystalline structure and drawability with low hygroscopicity.

20 Claims, No Drawings

WATER SOLUBLE SALT PRECOATS FOR WIRE DRAWING

CROSS-REFERENCE TO RELATED APPLICATIONS

This application is a division of copending application Ser. No. 492,697 filed Mar. 13, 1990, now U.S. Pat. No. 5,012,262 which was a continuation of application Ser. No. 307,643 filed Feb. 7, 1989, now abandoned.

BACKGROUND OF THE INVENTION

1. Field of the Invention

This invention relates to modified water soluble salt precoats for use in the cold drawing of steel wire.

2. Background of the Invention

Water soluble salt coatings are often applied to steel wire in the form of aqueous solutions prior to drawing. The solution-coated wire is dried and the resulting salt coated wire is then drawn through conventional reducing dies using dry soap lubricants—a process well-known to this art. The water soluble salt coating acts as a lubricant carrier, pulling the dry soap box lubricant into the dies, thus providing lubrication. These dried-in-place, water soluble salt coatings have proven to be superior to other conventional coatings such as lime or borax coatings because of their improved ability to carry lubricant into the dies. A typical soluble salt composition used for the coating of steel (usually stainless steel) wire contains both sodium sulfate and borax. Such soluble salt compositions provide coatings with excellent crystalline structure, resulting in good soap lubricant pick-up when the coated wire is passed through a soap box, and therefore good drawability. However, such salt coatings are prone to excessive moisture absorption upon exposure to ambient air, particularly when exposed to air having high humidity. Such moisture absorption seriously interferes with, or even prevents, the drawing of the coated wire. On the other hand, soluble salt coatings which provide low moisture absorption provide little or no crystalline structure (i.e. amorphous or glaze type coatings) and are significantly inferior in both lubricant pick-up and drawability. This Hobson's choice problem has not previously been solved.

STATEMENT OF THE INVENTION

Other than in the operating examples, or where otherwise indicated, all numbers expressing quantities of ingredients or reaction conditions used herein are to be understood as modified in all instances by the term "about".

Compositions for coating steel wire have now been discovered which provide uniform coatings with good crystalline structure, soap pick-up, and drawability, while at the same time low moisture absorption even during humid days, i.e. low hygroscopicity.

The compositions of the invention, which are in the form of dry mixtures prior to dilution with water for use, contain the following components:

A. from 50 to 99.99, preferably from 70 to 89.9% by weight $K_2SO_4$;

B. from 0 to 49.99, preferably from 10 to 29.9% by weight $K_2B_4O_7$ and/or $KBO_2$; and C. from 0.01 to 5, preferably from 0.1 to 1.0% by weight of an ammonium or potassium soap, wherein up to 50% by weight, and preferably no more than 10% by weight, of the total potassium ions and ammonium ions present in A., B. and C. can be replaced with sodium ions. More preferably, substantially none of the potassium and ammonium are replaced with sodium ions, since the more sodium ions present, the greater the hygroscopicity. When sodium ions are present, they can be present in one or more of components A., B. and C., e.g. component C. can be partially or entirely a sodium soap. Also, component A. and/or B. can be a sodium or a potassium salt, or a mixture of such salts, provided the limitation on total quantity of sodium ion is maintained.

The fact that the above compositions provide good crystallinity on steel wire is completely unexpected, since the above compositions without component C. give non-uniform coatings on steel wire which are not useful as such since both soap pick-up and drawability are unsatisfactory. In some unknown manner, the presence of the soap provides an at least partially crystalline uniform coating when the composition in aqueous solution is applied to the steel wire which is then dried or allowed to dry.

The $K_2SO_4$ used as component A. can be chemically pure or of a technical grade; the latter being preferred due to cost considerations.

The $K_2B_4O_7$ used as component B. can also be chemically pure or a technical grade, and is generally available and used herein as the tetrahydrate ($K_2B_4O_7 \cdot 4H_2O$). Similarly, the $KBO_2$, which can be used alone as component B, or in a mixture with $K_2B_4O_7$ in any proportions, can be chemically pure or a technical grade.

The ammonium or potassium soap is one or more ammonium and/or potassium salts of a $C_{12}$–$C_{22}$ fatty acid or mixture of two or more such $C_{12}$–$C_{22}$ fatty acids. The fatty acids are generally saturated and unbranched, with ammonium or potassium stearate being preferred for use herein, although mono- or di-olefinically unsaturated $C_{12}$–$C_{22}$ fatty acids can also be employed, either alone or in mixtures with each other and/or with saturated fatty acids. For example, ammonium and potassium soaps derived from the fatty acid mixtures obtained by the saponification of tallow oil or coconut oil, or a mixture thereof, can advantageously be employed as component C. Also, ammonium or potassium salts of branched or cycloaliphatic-containing $C_{12}$–$C_{22}$ fatty acids can also be employed herein, either alone or in mixtures with unbranched fatty acid salts. Also, ammonium or potassium rosin acids, e.g. abietic acid, can also be employed as component C.

The wires coated with the coating compositions of the invention are generally steel wires, and usually stainless steel wires. However, other wire substrates can also be coated with the present coating compositions such as mild steel, titanium, vanadium, tungsten, aluminum, copper, nickel, zirconium, etc., and alloys thereof.

The coatings are applied by contacting the wires with an aqueous solution of the composition of the invention, and allowing the resulting wet coating to dry in place, either with or without the application of heat. The aqueous solutions generally contain from 75 to 400 g/l of the composition in water, preferably from 150 to 250 g/l.

The wire is contacted with the solution by any convenient technique, either batch or a continuous strand, and allowing the resulting wet-coated wire to air dry before coiling for storage, shipping, or use. The coated wire is then passed through conventional cold reduction equipment using a soap box (e.g. containing a conventional dry soap lubricant). The coating on the wire functions as a carrier to carry the dry soap lubricant into the die.

The steps employed in the treatment of wire according to the invention include the following:

1. Cleaning the wire—cleaning compositions are well-known in the art and do not comprise part of the present invention.
2. Rinsing with water.
3. Pickling—here also, pickling compositions are well-known and the selection of a pickling composition is not part of the invention.
4. Rinsing with water.
5. Applying the coating composition of the invention as described above.
6. Drying the wire as described above to produce the coated wire of the invention. The coated wire can then be drawn, also as described above.

The water used in preparing the aqueous solutions of the invention is preferably distilled or deionized water, but tap water can also be used provided it is not overly hard and has a low dissolved sodium salts content.

The invention will be illustrated but not limited by the following examples.

EXAMPLES

Example 1

The following aqueous compositions were tested for their morphology and hygroscopicity, when coated on stainless steel panels. Stainless steel panels were coated with each of the following compositions by immersing the panels in the aqueous composition, removing the panels from the aqueous composition, and allowing them to flash (air) dry.

a) 187.2 g of a mixture of 75 wgt % $Na_2SO_4$ and 25 wgt % sodium tetraborate·$10H_2O$ per liter of deionized water. Use temperature 190° F.

b) 187.2 g of a mixture of 75 wgt % $K_2SO_4$ and 25 wgt % $K_2B_4O_7 \cdot 4H_2O$ per liter of deionized water. Use temperature 190° F.

c) to an aqueous solution prepared as in a) was added 5 g/l of sodium stearate. Use temperature 190° F.

d) to an aqueous solution prepared as in b) was added 5 g/l of ammonium stearate. Use temperature 190° F.

The sections of stainless steel panel coated with the above compositions were then tested for hygroscopicity and morphology. The test results are set forth in Table I below. In Table I, RH=relative humidity.

TABLE I

| Coating Bath Composition | Hygroscopicity:* 90–95% RH/ 90 min. | Ambient Air/ 24 hr. | Morphology |
|---|---|---|---|
| a) | 16.5% | 107.0% | Crystalline |
| b) | 5.1% | 2.7% | Amorphous glaze |
| c) | 16.1% | — | Crystalline/some glaze |
| d) | 7.5% | 3.4% | Crystalline/some glaze |

As can be seen from Table I, the composition of the invention, composition d), produced a coating with good crystallinity, and low hygroscopicity.

Example 2

This example shows the effect of relative ratios of sodium and potassium ions on the hygroscopicity of the water soluble salt coatings. In this example, stainless steel panels were coated in accordance with Example 1 using the following compositions, at a concentration of 187.2 g/l in deionized water, set forth in Table II below together with test results. In Table II, M=molarity or gm-moles/liter of solution and RH=relative humidity.

TABLE II

| | Coating Bath Composition: Na, M | K, M | $SO_4$, M | $B_4O_7$, M | Stearate, M | Hygroscopicity: 90–95% RH/24 hrs. |
|---|---|---|---|---|---|---|
| e) | 2.23 | — | 0.99 | 0.123 | — | 107.0% |
| f) | 1.98 | 0.246 | 0.99 | 0.123 | — | 90.2% |
| g) | 0.246 | 1.98 | 0.99 | 0.123 | — | 10.6% |
| h) | — | 2.23 | 0.99 | 0.123 | — | 2.7% |
| i) | — | 2.23 | 0.99 | 0.123 | 0.016 | 3.4% |

Example 3

This example shows the relative hygroscopicity of lime coatings compared to the coating from a known sodium based salt composition and a low sodium salt composition of the invention. The coatings were produced on samples of the stainless steel wire used in Example 1 according to the procedure of Example 1 from the following aqueous compositions:

j) 187.2 g of a mixture of 75 wgt % $Na_2SO_4$ and 25 wgt % sodium tetraborate·$10H_2O$ per liter of deionized water. Use temperature 190° F.

k) 187.2 g of a mixture of 79 wgt % $K_2SO_4$, 20 wgt % sodium tetraborate·$10H_2O$, and 1 mole % of ammonium stearate per liter of deionized water. Use temperature 190° F.

l) 3% by weight of lime in deionized water. Use temperature 190° F.

m) 6% by weight of lime in deionized water. Use temperature 190° F.

The results are shown in Table III below.

TABLE III

| Coating Bath Composition | % moisture pick-up, 80–90% RH, 24 hrs. |
|---|---|
| j) | 28.3% |
| k) | 3.0% |
| l) | 17.6% |
| m) | 18.4% |

As can be seen from Table III above, composition k) in accordance with the invention has significantly reduced hygroscopicity compared to lime coatings l) and m).

Example 4

Ten different coating bath compositions were evaluated for moisture pick up, morphology, coating uniformity, and crystals per inch on stainless steel panels.

The stainless steel panels were coated with the coating compositions and coating baths set forth in Table IV, according to the process given in Example 1, except that the wet-coated panels were dried using a 10 minute bake at 250° F. Moisture pick-up was determined in a chamber which allowed constant temperature and humidity of 80° F. and 92% respectively. A Surtronic 3 surface prophylometer was used to determine the number of crystals per inch of coating. Coating characterization and coating appearance were determined by visual observation.

TABLE IV

| Coating Bath Ingredients | Coating Bath Composition (g/l) Sodium | Potassium | Sulfate | Tetra Borate | g/l Stearate | Moisture Pick-Up 120 Min. RM = 92% @ 80 F. | Crystals Per Inch | Coating Characterization | Coating Appearance |
|---|---|---|---|---|---|---|---|---|---|
| A- Sodium Sulfate | 54.3 | — | 113.2 | — | — | 120% | 87 | Mixed Glaze/ Crystalline | Non-Uniform |
| B- Sodium Sulfate and Sodium Tetraborate | 51.9 | — | 96.3 | 19.3 | — | 98% | 126 | Crystalline | Uniform |
| C- Sodium Sulfate and Sodium Stearate Soap (10.0 g/l) | 55.0 | — | 113.2 | — | 9.3 | 103% | 167 | Crystalline | Non-Uniform |
| D- Potassium Sulfate | — | 75.2 | 92.3 | — | — | 0% | 43 | Mixed, Mostly Glaze | Non-Uniform |
| E- Potassium Sulfate and Sodium Stearate Soap (10.0 g/l) | 0.7 | 75.2 | 92.3 | — | 9.3 | 1% | 50 | Mixed, Mostly Glaze | Non-Uniform |
| F- Potassium Sulfate and Sodium Stearate Soap (0.1 g/l) | trace | 75.2 | 92.3 | — | 0.09 | 1% | 80 | Mixed Glaze/ Crystalline | Uniform |
| G- Potassium Sulfate and Ammonium Stearate Soap (0.1 g/l) | — | 75.2 | 92.3 | — | 0.09 | 1% | 77 | Mixed Glaze/ Crystalline | Uniform |
| H- Potassium Sulfate and Potassium Tetraborate | — | 72.3 | 78.6 | 16.7 | — | 4% | 93 | Mixed Glaze/ Crystalline | Non-Uniform |
| I- Potassium Sulfate and Sodium Tetraborate | 5.7 | 63.9 | 78.6 | 19.6 | — | 7% | 86 | Mixed Glaze/ Crystalline | Non-Uniform |
| J- Potassium Sulfate, Sodium Tetraborate and Sodium Stearate | 5.7 | 63.9 | 78.6 | 19.6 | 0.09 | 5% | 153 | Crystalline | Uniform |

In Table IV, coating compositions F, G, and J are compositions in accordance with the invention, while compositions A, B, C, D, E, H and I are comparison compositions. As can be seen from Table IV, compositions F, G and J produced uniform coatings while exhibiting low moisture pick up. The only comparison composition that produced a uniform coating was composition B, which however exhibited an unacceptably high moisture pick up. In fact, compositions A, B, and C all exhibited unacceptably high moisture pick up, and hence poor wire drawability properties in humid conditions. Coating composition E contains potassium sulfate and sodium stearate soap in accordance with the compositions of the invention, except that the sodium stearate soap is present in too high a quantity, resulting in a non-uniform, mostly glaze coating, having unacceptable wire drawing properties. Coating compositions D, H, and I which are potassium salt compositions in accordance with the invention except that no soap is present therein, all produced unacceptable non-uniform coatings and hence unacceptability inconsistent wire drawing characteristics. In comparing coating compositions F, G and J of the invention, composition J containing an alkali metal tetraborate produced the most crystalline coating. Hence, the presence of a tetraborate in the coating compositions of the invention, while optional, is nonetheless highly preferred.

I claim:

1. A composition for coating steel wire to facilitate the cold drawing thereof, said composition comprising:

(A) from about 50 to about 99.9% by weight of a component selected from the group consisting of $Na_2SO_4$, $K_2SO_4$, and mixtures thereof;

(B) from about 0 to about 49.9% by weight of a component selected from the group consisting of $Na_2B_4O_7$, $NaBO_2$, $K_2B_4O_7$, $KBO_2$ and mixtures of any two or more thereof; and (C) from about 0.01 to about 5% by weight of a component selected from the group consisting of potassium soaps, sodium soaps, and ammonium soaps;

wherein the percentages by weight are based on the total weight of components A, B, and C in the composition, and wherein not more than 50% by weight of the total of sodium plus potassium plus ammonium ions in components A, B, and C of the composition consists of sodium ions.

2. The composition of claim 1, comprising ammonium stearate or potassium stearate.

3. An aqueous solution containing from about 75 to about 400 grams of the composition of claim 2 per liter of the aqueous solution.

4. The composition of claim 1 wherein not more than 10% by weight of the total of sodium plus potassium plus ammonium ions in the composition consists of sodium ions.

5. An aqueous solution containing from about 75 to about 400 grams of the composition of claim 4 per liter of the aqueous solution.

6. The composition of claim 1 wherein there are substantially no sodium ions.

7. An aqueous solution containing from about 75 to about 400 grams of the composition of claim 6 per liter of the aqueous solution.

8. The composition of claim 1 wherein component A is present in from about 70 to about 89.9% by weight.

9. An aqueous solution containing from about 75 to about 400 grams of the composition of claim 8 per liter of the aqueous solution.

10. The composition of claim 1 wherein component B is present in from about 10 to about 29.9% by weight.

11. An aqueous solution containing from about 75 to about 400 grams of the composition of claim 10 per liter of the aqueous solution.

12. The composition of claim 1 wherein component C is present in from about 0.1 to about 1.0% by weight.

13. An aqueous solution containing from about 75 to about 400 grams of the composition of claim 12 per liter of the aqueous solution.

14. The composition of claim 1 wherein component A is present in from about 70 to about 89.9% by weight component B is present in from about 10 to about 29.9% by weight and component C is present in from about 0.1 to about 1.0% by weight.

15. An aqueous solution containing from about 75 to about 400 grams of the composition of claim 14 per liter of the aqueous solution.

16. The composition of claim 1 wherein component B is $K_2B_4O_7$ present in the form of its tetrahydrate.

17. An aqueous solution containing from about 75 to about 400 grams of the composition of claim 16 per liter of the aqueous solution.

18. An aqueous coating solution containing the composition of claim 1.

19. An aqueous solution containing from about 75 to about 400 g/l of the composition of claim 1.

20. An aqueous solution containing from about 150 to about 250 g/l of the composition of claim 1.

* * * * *